US005850203A

United States Patent [19]

Yamazaki et al.

[11] Patent Number: 5,850,203

[45] Date of Patent: Dec. 15, 1998

[54] METHOD FOR DRIVING SIMPLE MATRIX-TYPE LIQUID CRYSTAL DISPLAY

[75] Inventors: Tsuneo Yamazaki; Eui-yeul Park, both of Ulsan-city, Rep. of Korea

[73] Assignee: Samsung Display Devices Co. Ltd., Kyungki-Do, Rep. of Korea

[21] Appl. No.: 710,059

[22] Filed: Sep. 10, 1996

[30] Foreign Application Priority Data

Dec. 28, 1995 [KR] Rep. of Korea ..... 1995 62152

[51] Int. Cl.[6] ..... G09G 3/36

[52] U.S. Cl. ..... 345/94; 345/87

[58] Field of Search ..... 345/87, 94, 96

[56] References Cited

U.S. PATENT DOCUMENTS 4,745,485 5/1988 Iwasaki .

FOREIGN PATENT DOCUMENTS 0371665 11/1989 European Pat. Off. .

61056327 3/1986 Japan .

6175619 6/1994 Japan .

WO92/21122 4/1992 WIPO .

OTHER PUBLICATIONS

"The explanation of Flicker in a Standard LCD"; 21st Japanese Liquid Crystal Forum Lecture, Sep. 10, 1995.

*Primary Examiner*—Jeffery Brier

*Attorney, Agent, or Firm*—Leydig, Voit & Mayer

[57] ABSTRACT

A simple matrix-type liquid crystal display is driven by a frame signal for indicating the starting point of each frame on a screen, a latch clock signal for latching an input data signal in a unit of a horizontal line of the liquid crystal display, and a modulation signal for controlling polarity of a voltage applied to each cell of the liquid crystal display. The phase difference between the modulation signal and the frame signal is controlled to lower and minimize flicker intensity. The reliability of the liquid crystal cell is preserved and flicker is prevented so that the picture quality is improved and life of the simple matrix-type liquid crystal display is extended.

8 Claims, 6 Drawing Sheets

METHOD FOR DRIVING SIMPLE MATRIX-TYPE LIQUID CRYSTAL DISPLAY

BACKGROUND OF THE INVENTION

The present invention relates to a method for driving a simple matrix-type LCD (Liquid Crystal Display), and more particularly, to a simple matrix-type LCD driving method wherein reliability of liquid crystal cells is preserved and flicker is prevented.

LCD driving methods are roughly classified into a static driving method and a multiplex driving method. The former is the most basic method for displaying segments, wherein all segment electrodes are separately driven. The latter is referred to as a dynamic or time-sharing driving method which is employed to display relatively many numbers. In this method, all segment electrodes are divided into multiplex groups, and then the respective groups are driven in a time-sharing system. The latter is also divided into a simple matrix type and an active matrix type.

In the simple matrix type, a liquid crystal is driven by forming an electric field between common electrode groups and segment electrode groups, each group is formed inside upper and lower substrates.

FIG. 1 is a circuit diagram showing the driving of a typical simple matrix-type LCD. As shown in FIG. 1, an LCD panel is generally divided into upper and lower LCD panels 1 and 2. Segment electrode groups (not shown) of the upper LCD panel 1 are driven by an upper segment driver 3, and those of the lower LCD panel 2 are driven by a lower segment driver 4. A common driving part 6 drives common electrode groups (not shown) of the upper and lower LCD panels 1 and 2. Here, a data signal, a shift clock signal, a frame signal, and a latch clock signal are provided from a computer such as a notebook personal computer PC. The frame signal FRM indicates the starting point of each frame on a screen. Also, the shift clock signal allows the data signal to make a sequential movement from the left to the right on a screen. The latch clock signal from a modulation signal generator 5 latches the input data signal in a unit of a horizontal line. Meanwhile, a modulation signal generated by demultiplexing the latch clock signal in a modulation signal generating part 5 controls the polarity of voltage being applied to the cells of the LCD panels 1 and 2. For instance, if the modulation signal is high, the voltage polarity becomes positive; but if it is low, the polarity becomes negative.

FIG. 2 shows the timing of the input signals of FIG. 1. Here, a data signal on a horizontal line is input by applying 240 shift clock signals during the period for a horizontal scan. The input data signal is latched by the latch clock signal and then output through a segment line during the next period for horizontal scanning. Here, when 244 latch clock signals are input, a new frame is opened according to the frame signal. As described in FIG. 2, 10 modulation signals per one frame are generated. That is, the frequency ratio of the latch clock signal with respect to the modulation signal is 26, and thus the polarity of voltage applied to the common line is changed in a unit of 13 lines.

FIG. 3 illustrates a screen showing a flicker phenomenon of a simple matrix-type LCD. The flicker phenomenon, a big problem of the simple matrix-type LCD, can be defined in that, as the common line's brightness designated as a horizontal arc 31 varies periodically with a frequency of several Hertz, the horizontal arc looks like it is moving up and down.

To prevent this flicker phenomenon, the present inventors have presented an essay entitled "The Explanation of Flicker in a Standard LCD" in a preliminary notice-book for the 21st Japanese Liquid Crystal Forum lecture, published on Oct. 9, 1995. The contents of the essay are described below.

FIG. 4 is a characteristic view showing the relationship of LCD transmissivity $R_t$ with respect to the modulation signal frequency $f_M$, to explain a method for driving a conventional simple matrix-type LCD. As described in FIG. 4, if the frequency $f_M$ of the modulation signal is adjusted to a region in which the LCD transmissivity $R_t$ is constant, most of the flicker is prevented.

FIG. 5 is a characteristic view showing the relationship of the flicker frequency $f_F$ and intensity $I_F$ used to analyze the flicker suppressing region of FIG. 4. Here, the flicker expressed as a frequency of about 67 Hz is not visually detected, but the flicker expressed as the frequency of about 4.9 Hz is visually detected. Meanwhile, the flicker frequency $f_F$ is inversely proportional to the frequency ratio $$\frac{(f_L/f_M)}{2}$$

of the latch clock signal with respect to the modulation signal.

FIG. 6 is a graph showing the relationship of the flicker frequency $f_F$ of FIG. 5 and the frequency ratio of the latch clock signal with respect to the modulation signal $f_L/f_M$. Referring to FIG. 6, the values generated from dividing the frequency multiple-ratio of the latch clock signal with respect to the modulation signal by two are arranged on the X-axis. A solid line (A) denotes a measured value, and a broken line (B) denotes a calculated value. As described above, the flicker frequency $f_F$ and the frequency multiple-ratio $f_L/f_M$ of the latch clock signal with respect to the modulation signal are inversely proportional to each other. That is, it can be recognized that the flicker frequency $f_F$ is inversely proportional to the frequency ratio $$\frac{(f_L/f_M)}{2}$$

of the latch clock signal with respect to the modulation signal.

According to the principle described in FIGS. 4, 5, and 6, a method for increasing the frequency of the modulation signal when cells are not selected is adopted to prevent the flicker phenomenon. That is, when the cells are not selected during driving, the frequency ratio $f_M/f_L$ of the modulation signal with respect to the latch clock signal is increased so that the flicker will not be noticeable.

However, the foregoing method has the following problems. First, since the frequency of the modulation signal must decrease relatively to select the cells, flicker is not prevented. Second, as the frequency of the modulation signal increases, the probability of generating cross talk between adjacent cells is increased. Third, when the frequency of the modulation signal is regulated arbitrarily, a voltage having an identical polarity may be continuously applied to one cell, thereby deteriorating the reliability of the liquid crystal cell. As a result, the picture quality and life span of the simple matrix-type LCD may decrease.

SUMMARY OF THE INVENTION

To solve the above problems, it is an object of the present invention to provide a method for driving a simple matrix-type LCD whereby reliability of a liquid crystal cell is preserved, and flicker can be prevented.

To accomplish the object, there is provided a method for driving a simple matrix-type LCD using a frame signal for indicating the starting point of each frame on a screen, a latch clock signal for latching an input data signal in a unit of a horizontal line, and a modulation signal for controlling the direction of applying the electric field to an LCD cell, wherein the phase of the modulation signal with respect to the frame signal is controlled to reduce flicker.

BRIEF DESCRIPTION OF THE DRAWINGS

The above object and advantage of the present invention will become more apparent by describing in detail a preferred embodiment thereof with reference to the attached drawings in which.

DETAILED DESCRIPTION OF THE INVENTION

The present embodiment analyzes the characteristics of flicker intensity with respect to a phase value of a modulation signal.

The phase value $P_M$ of the modulation signal may be calculated as described below. First, a Least Common Multiple, LCM, n, of a number of latch clock signals per frame, L/F, and a frequency ratio, $f_L/f_M$, of the latch clock signal with respect to the modulation signal must be obtained. That is, n equals the LCM (L/F, $f_L/f_M$). Next, a quotient N of the LCM, n, divided by the number of latch clock signals per frame L/F must be sought. That is, N=n/(L/F)=LCM (L/F, $f_L/f_M$)/(L/F). Here, N denotes the phase difference of the modulation signal with respect to the frame signal. For example, N can be defined as the number of latch clock signals between a frame signal, FRM, and its first modulation signal, M SIG. Also, a flicker frequency $f_F$ can be obtained by dividing a frame frequency $f_{FRM}$ by the phase value N. That is, $f_F$ equals $f_{FRM}$/N. However, it is not preferable to prevent flicker by simply increasing the flicker frequency $f_F$ as in the conventional method. Thus, to realize the present embodiment, an experiment was conducted to gain an understanding of the relationship between the phase difference N and flicker intensity.

Figure 7:
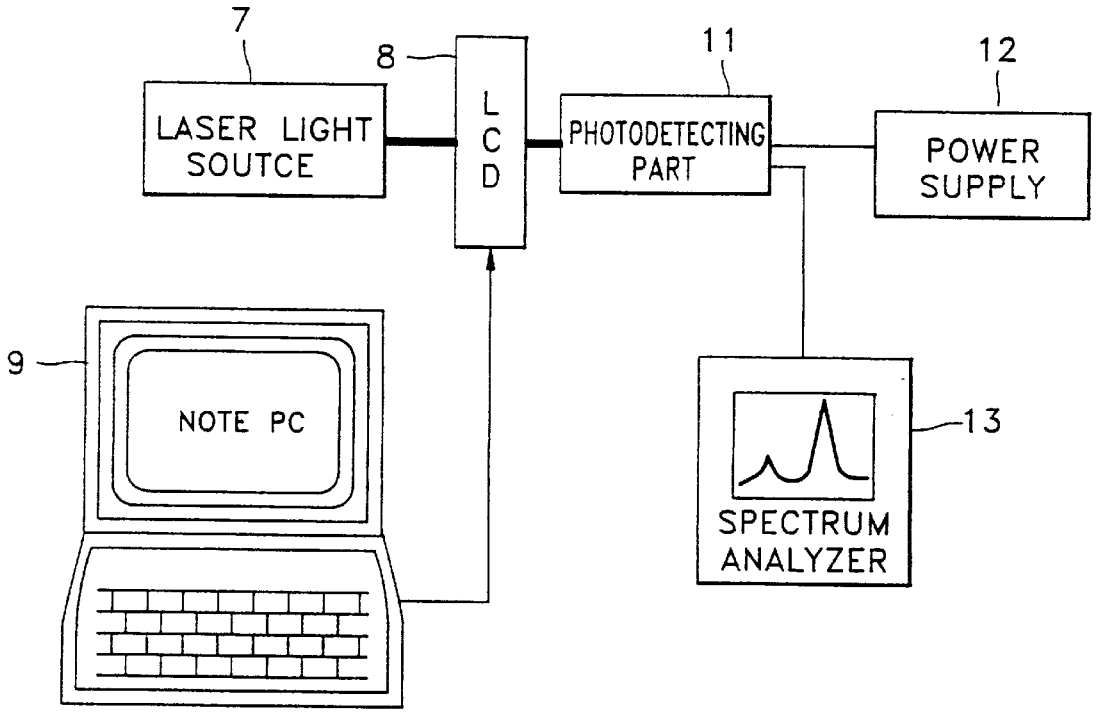
FIG. 7 is a schematic view of a flicker measuring system for an LCD used for the experiment of the present invention.

FIG. 7 is a schematic view showing a flicker measuring system for an LCD used in the experiment. Here, a laser light source 7 employs a helium-neon laser for generating laser light beam about 1 mm in diameter. An LCD panel 8 was driven by a PC 9, such as a notebook PC to display only white color. At this time, the frame frequency was set at 67 Hz, and the number of latch clock pulses per frame was set at 242 Latch/FRM at which flicker intensity is high. The laser light was transmitted through the LCD panel 8 being driven by the PC 9 and was detected in a photo-detector 11. The DC level of the detected signal was regulated by a power supply 12 and then output to a spectrum analyzer 13. Thus, the spectrum of the detected signal was analyzed by performing a Fourier transformation on the input signal. At that time, about 10 seconds of the input signal was required to precisely observe the spectrum of 1 Hz. Meanwhile, since the transmitted light was changed into a time unit of about 1 μsec, the time for data sampling was set at less than 1 μsec.

Figure 8:
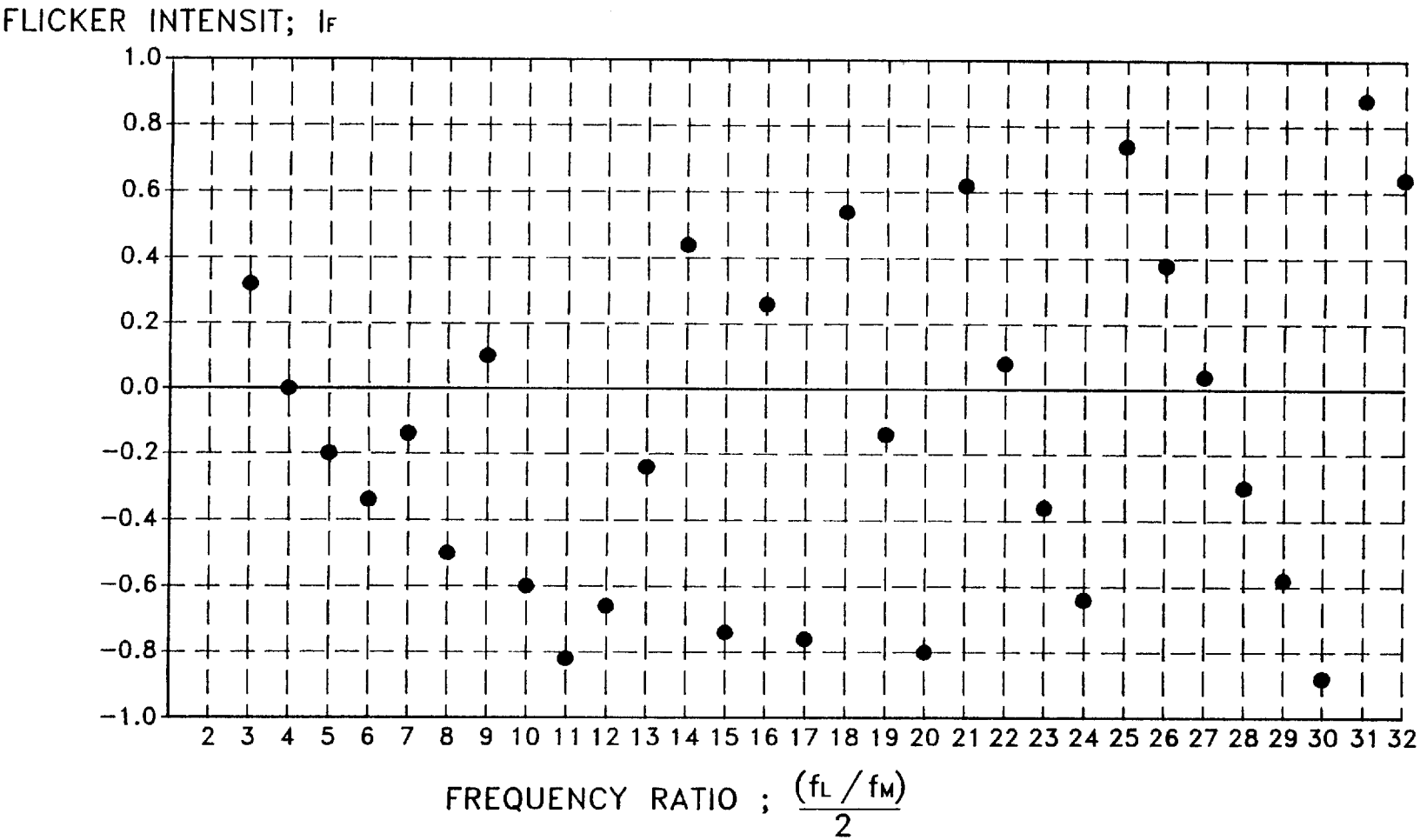
FIG. 8 is a graph illustrating the relationship between flicker intensity and frequency ratio of a latch clock signal with respect to a modulation signal, for the purpose of explaining a method for driving a simple matrix-type LCD according to the present invention.

FIG. 8 is a graph illustrating the relationship between flicker intensity and the frequency ratio of the latch clock signal with respect to the modulation signal, for the purpose of explaining a method for driving a simple matrix-type LCD according to the present invention. Here, the X-axis represents the frequency ratio $$\frac{(f_L/f_M)}{2}$$

of the latch clock signal with respect to the modulation signal. The relative flicker intensity with respect to its polarity is represented on the Y-axis. The actual flicker intensity operates as an absolute value obtained by disregarding an polarity. When the number (L/F) of the latch clock signals per frame is 244, if the flicker intensity $I_F$ is measured while changing the frequency ratio $$\frac{(f_L/f_M)}{2}$$

of the latch clock signal with respect to the modulation signal, the characteristic view of FIG. 8 can be obtained.

According to an analysis of FIG. 8, the flicker intensity $I_F$ could be calculated in accordance with the following processes. First, the number L/F of the latch clock signals per frame is obtained. Then, the frequency ratio $$\frac{(f_L/f_M)}{2}$$

of the latch clock signal with respect to the modulation signal is obtained. A first result value is obtained by dividing the number L/F of the latch clock signal by the frequency ratio $$\frac{(f_L/f_M)}{2}.$$

The odd integer nearest to the first result value is found. Next, a second result value, i.e., the flicker intensity $I_F$, is obtained by subtracting the odd number from the first result value. For example, if the number L/F of the latch clock signal per frame is 244 and the frequency ratio $$\frac{(f_L/f_M)}{2}$$

of the latch clock signal with respect to the modulation signal is 13, the first result value is 244/13, that is, 18.7692 . . . . Since the odd number nearest to the first result value "18.7692 . . . " is 19, the flicker intensity $I_F$ is a value calculated by subtracting 19 from "18.7692 . . . ", i.e., −0.2307 . . . If the frequency ratio $$\frac{(f_L/f_M)}{2}$$

of the latch clock signal with respect to the modulation signal is 13, the flicker intensity $I_F$ of FIG. 8 can be identified to be "−0.2307 . . . ". If the absolute value of the flicker intensity $I_F$ calculated above is 0.3 or below, no flicker maybe visually identified. Thus, it is preferable that the relationship between the number L/F of the latch clock signal per frame and frequency division ratio $f_M/f_L$ of the modulation signal with respect to the latch clock signal is set so that the absolute value of $I_F$ is 0.3 or below.

Figure 1:
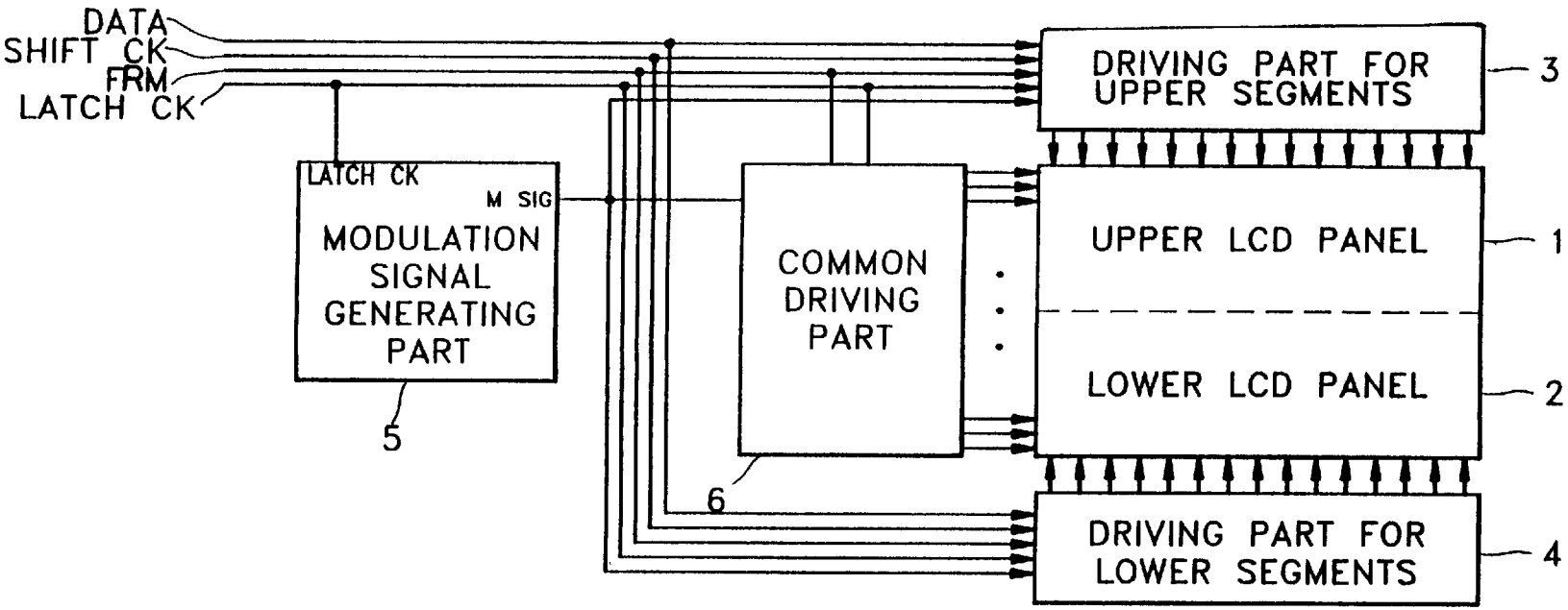
FIG. 1 is a circuit diagram illustrating the driving of a typical simple matrix-type LCD.
Figure 2:
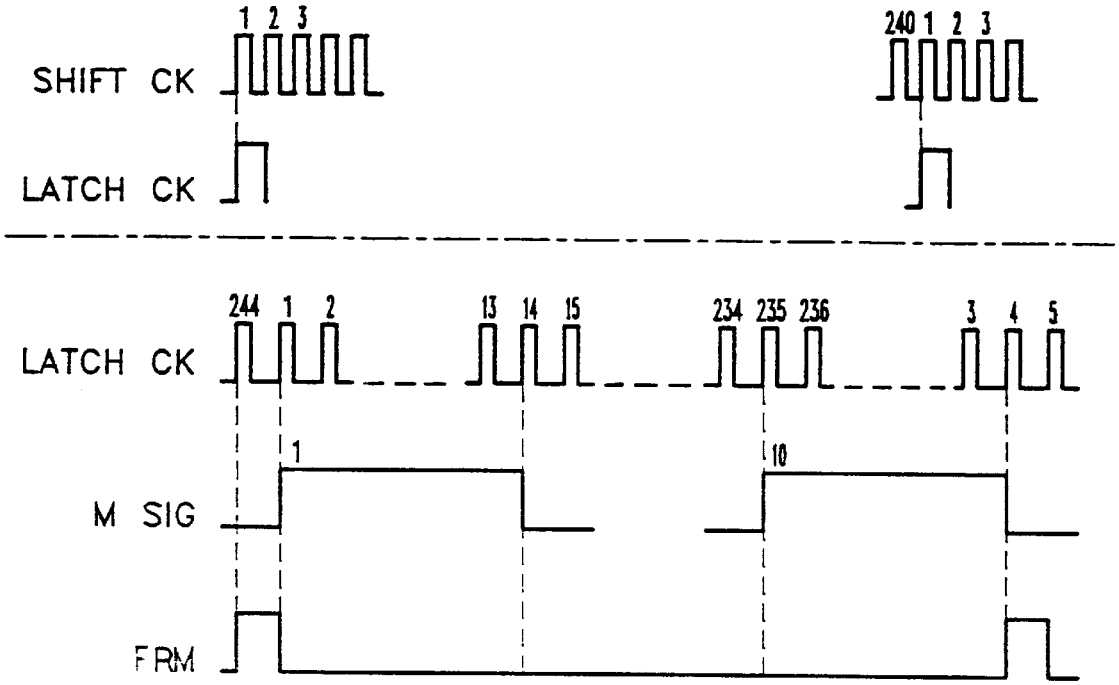
FIG. 2 is the timing chart of the input signals of FIG. 1.
Figure 3:
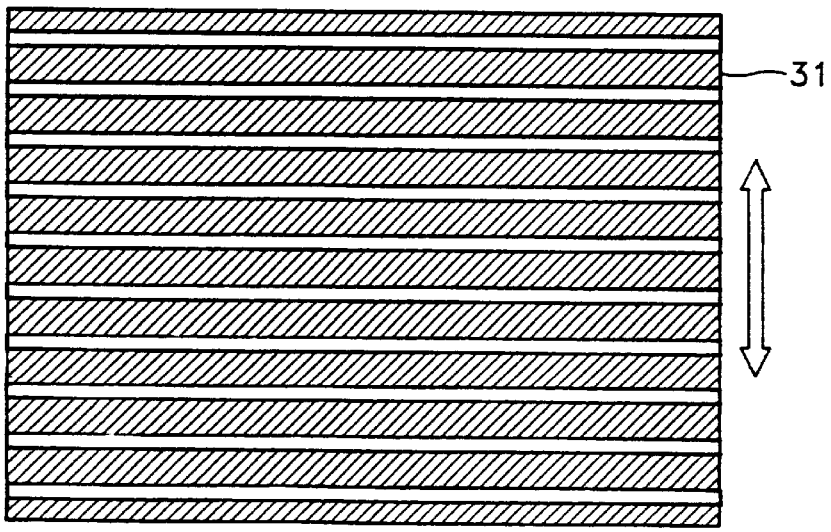
FIG. 3 is a schematic view of a screen used to describe a flicker phenomenon of a simple matrix-type LCD.
Figure 4:
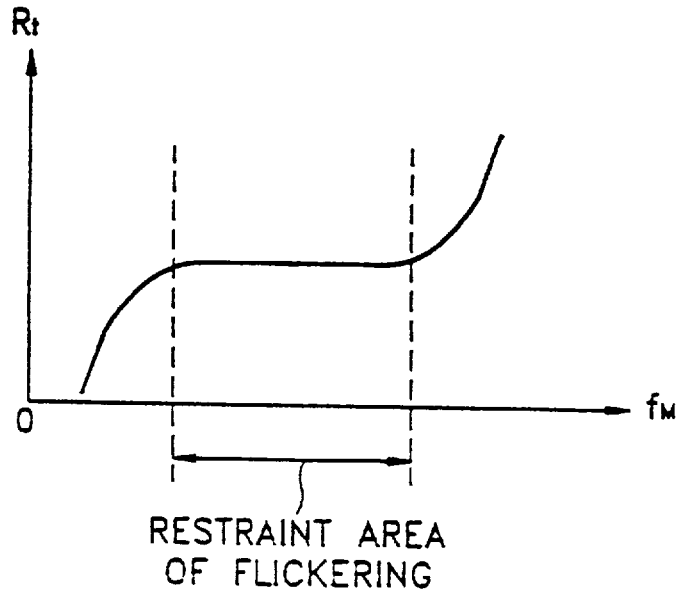
FIG. 4 is a characteristic of the relationship of LCD transmissivity with respect to modulation signal frequency, for the purpose of explaining a method for driving a conventional simple matrix-type LCD.
Figure 5:
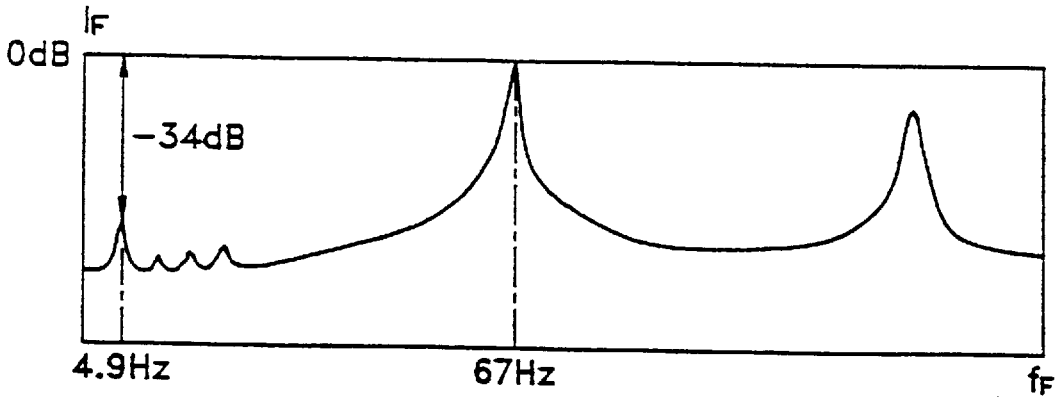
FIG. 5 is a characteristic view showing the relationship between flicker frequency and intensity, for the purpose of analyzing the flicker suppressing region of FIG. 4.
Figure 6:
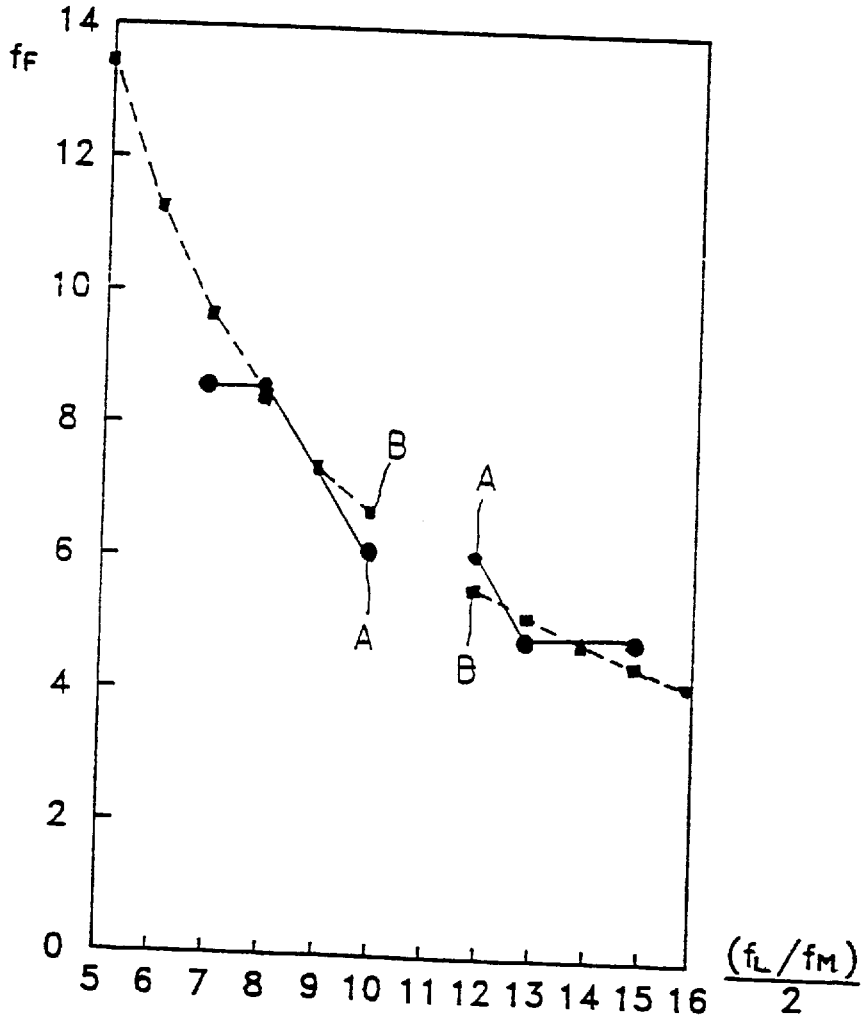
FIG. 6 is a graph showing the relationship between the flicker frequency of FIG. 5 and the frequency multiple-ratio of a latch clock signal with respect to a modulation signal.

As described above, the flicker intensity $I_F$ is determined by the relationship between the number L/F of the latch clock signals per frame and the frequency ratio $f_L/f_M$ of the latch clock signal with respect to the modulation signal. The relationship therebetween can be regulated according to a phase difference N of the modulation signal with respect to the frame signal. The phase difference N, an LCM (L/F, $f_L/f_M$)/(L/F), designates the number of latch clock signals between a frame signal and a first modulation signal with respect to the frame signal. For example, when the number L/F of the latch clock signals per frame is 244 and the frequency ratio $f_L/f_M$ of the latch clock signal with respect to the modulation signal is 26 (the case of FIG. 2), the phase difference N is calculated as LCM (244, 26)/244, that is, 13. Here, if a period T of the modulation signal designated as the number of the latch clock signals, is set as $2\pi$ [rad], the phase difference N can be calculated in terms of $2\pi N/T$ [rad]. For example, when the phase difference N is 13, it is calculated in terms of $26\pi/26$ [rad], that is, $\pi$ [rad]. As a result of calculating the number of latch clock signals expressed as the phase difference in terms of a real angle and analyzing the calculated angle, it can be recognized that there is no flicker when the phase difference of the modulation signal is 180° ($\pi$).

Thus, the LCD is driven by regulating the phase of the modulation signal with respect to the frame signal, whereby the intensity of the flicker is lowered. Meanwhile, if the phase difference N expressed as the number of latch clock signals is odd, the probability of continuously applying a voltage of the same polarity, that is, a DC voltage, to one cell is high. Therefore, the phase difference N is set as an even number to preserve the reliability of the liquid crystal cell. Also, if the quotient of the number L/F of the latch clock signal per frame divided by the frequency ratio $$\frac{(f_L/f_M)}{2}$$

is required to be an even number, the probability of applying voltages having an identical polarity to a cell gets lowered. When the flicker intensity $I_F$ of FIG. 8, has a positive polarity, the probability of applying voltages having an identical polarity to a cell is high. On the contrary, when the flicker intensity $I_F$ has a negative polarity, the probability of applying voltages having an identical polarity to a cell is low. In FIG. 8, it can be recognized that (L/F) equaling 244, when the quotient of the latch clock signal divided by the frequency ratio $$\frac{(f_L/f_M)}{2}$$

is an even numbers the flicker intensity $I_F$ has a negative polarity.

As described above, according to the method for driving the simple matrix-type LCD of the present invention, flicker is prevented while preserving the reliability of the liquid crystal cell, which results in improved picture-quality and increased life span.

What is claimed is:

1. A method for driving a simple matrix-type liquid crystal display (LCD) having a plurality of cells using a frame signal, a latch clock signal, and a modulation signal, the method comprising:

indicating the starting point of each frame on a screen using the frame signal, latching an input data signal in a unit of a horizontal line using the latch clock signal, controlling polarity of a driving voltage applied to respective cells of the LCD using the modulation signal, and reducing flicker intensity of the LCD by controlling phase difference between the modulation signal and the frame signal to approach 180°.

2. The method for driving a simple matrix-type LCD as claimed in claim 1, including calculating the phase difference by:

calculating a least common multiple of (i) latch clock signals per unit frame and (ii) latch clock frequency divided by modulation signal frequency; and expressing a quotient of the least common multiple divided by the latch clock signals per unit frame as the phase difference.

3. The method for driving a simple matrix-type LCD as claimed in claim 2 including controlling the latch clock signals per frame divided by the quotient of the latch clock signal frequency and the modulation signal frequency so that the phase difference is even.

4. The method for driving a simple matrix-type LCD as claimed in claim 2, wherein, if a period T of the modulation signal, expressed as a number of latch clock signals, is set as $2\pi$ radians, calculating the phase difference as $2\pi\cdot${the least common multiple of (i) latch clock signals per frame and (ii) latch clock frequency divided by modulation signal frequency, divided by latch clock signal per frame}/T, in radians.

5. The method for driving a simple matrix-type LCD as claimed in claim 4, including controlling the phase difference to be about 180°.

6. The method for driving a simple matrix-type LCD as claimed in claim 1, including calculating flicker intensity by:

calculating the latch clock signals per frame, L/F;

calculating a frequency ratio of one-half latch clock signal frequency to modulation signal frequency;

obtaining a resultant value by dividing the L/F by the frequency ratio;

finding the odd number nearest the resultant value; and obtaining the flicker intensity by subtracting the odd number from the resultant value.

7. The method for driving a simple matrix-type LCD as claimed in claim 6, including controlling the L/F and the frequency ratio so that the flicker intensity has an absolute value not exceeding 0.3.

8. The method for driving a simple matrix-type LCD as claimed in claim 7, including controlling the L/F and the frequency ratio so that the resultant value is even.

* * * * *